US006299325B1

(12) United States Patent
Cathel

(10) Patent No.: US 6,299,325 B1
(45) Date of Patent: Oct. 9, 2001

(54) ILLUMINATING ADDRESS INDICATION DEVICE

(76) Inventor: Wayne Cathel, 806 Ponce de Leon Blvd., Belleair, FL (US) 33756

( * ) Notice: Subject to any disclaimer, the term of this patent is extended or adjusted under 35 U.S.C. 154(b) by 0 days.

(21) Appl. No.: 09/539,050

(22) Filed: Mar. 30, 2000

(51) Int. Cl.[7] ..... F21L 13/00

(52) U.S. Cl. ..... 362/183; 362/145; 40/566; 40/553; 232/34

(58) Field of Search ..... 362/812, 157, 362/190, 192, 183, 227, 249, 251, 276, 311, 145, 308, 394, 802; 40/541, 542, 564, 566, 572, 553; 232/1 R, 17, 20, 21, 34

(56) References Cited

U.S. PATENT DOCUMENTS

| | | | | |
|---|---|---|---|---|
| 1,842,597 | * | 1/1932 | Foti | 40/566 |
| 1,979,727 | * | 11/1934 | Bennett et al. | 40/561 |
| 2,452,667 | * | 11/1948 | Lambert | 40/566 |
| 4,384,317 | * | 5/1983 | Stackpole | 362/183 |
| 4,611,265 | * | 9/1986 | Davis | 362/145 |
| 5,101,329 | * | 3/1992 | Doyle | 362/183 |
| 5,143,285 | * | 9/1992 | Wise | 232/39 |
| 5,303,124 | * | 4/1994 | Wrobel | 362/20 |
| 5,460,325 | * | 10/1995 | Surman | 232/17 |
| 5,522,540 | * | 6/1996 | Surman | 232/17 |
| 5,635,902 | * | 6/1997 | Hochstein | 340/433 |
| 5,649,378 | * | 7/1997 | Roesser et al. | 40/559 |
| 5,832,642 | * | 11/1998 | Dalton | 40/546 |
| 5,850,126 | * | 12/1998 | Kanbar | 315/200 A |
| 5,897,194 | * | 4/1999 | Ham | 362/20 |

* cited by examiner

*Primary Examiner*—Alan Cariaso
*Assistant Examiner*—Ismael Negron
(74) *Attorney, Agent, or Firm*—Larson & Larson, P.A.; James E. Larson

(57) ABSTRACT

An illuminating mailbox address indication device includes a generally rectangular shaped housing mounted on a top portion of a mailbox. Enclosed within the housing is a light means powered by a set of batteries which are rechargeably energized by a solar cell mounted upon the housing. A photosensitive cell operates a switch to permit the light means to illuminate when a pre-determined threshold has been exceeded relevant to the amount of ambient light present around the mailbox. The housing walls are translucent and further include indica stenciled thereupon which represent the address of the property associated with the mailbox.

18 Claims, 5 Drawing Sheets

ILLUMINATING ADDRESS INDICATION DEVICE

BACKGROUND OF THE INVENTION

1. Field of the Invention

This invention relates to property address indication. More particularly, it relates to a device for mounting upon the top of a mailbox which is capable of illuminating the address of the property associated with the mailbox so it can be seen in the absence of light.

2. Description of Prior Art

Mailboxes are well known in the prior art and are the most commonly used devices for delivery of mail by the U.S. Postal Service. Typically, a mailbox associated with a particular home or business is located along the edge of the property on which the home or business is situated. The mailbox may have the address of the property, in the form of indica, stenciled upon the mailbox which assists the mail delivery person in identifying the address of the home or business. Typically, mail is delivered by the U.S. Postal Service during daylight hours, therefore there is no need to illuminate the address indicia. However, the indicia also acts to guide others who may be attempting to locate a particular home or business. For instance, if a certain individual lives at 125 Main Street, a person trying to locate this property may look at the numbers stenciled on the mailbox until number 125 is recognized while driving on Main Street thereby indicating that the desired property has been located.

At night however, this may be more difficult. It can be very difficult to legibly read the address numbers on mailboxes due to the absence of light. Even on well lit streets, it can be difficult to read the indicia stenciled on the mailbox. If the individual is driving a motorized vehicle and there is other motorized vehicles behind the lead vehicle, it quickly becomes dangerous to repeatedly slow down and speed while attempting to locate the home or business.

Of course, many homes are well lit and specifically shine light upon indicia which may be stenciled directly to the house or business. This certainly can assist in identifying the address of a particular property. However, in rural areas, many homes, for instance, are situated far from the entrance of the driveway. Typically though, the mailbox remains mounted proximal to the entrance of the driveway. Accordingly, the same problem persists as described above. In low light settings, individuals will find it difficult to locate the home or business that they seek due to not be able to read the indicia which identifies the particular home or business.

Some have attempted to alleviate this dilemma by mounting indicia on a small illuminated box. These devices are typically staked into the ground near the entrance of the property. Unfortunately, such a device has inherent deficiencies. First and foremost, most people are not looking at the ground of the property but the mailbox or building itself in an attempt to locate a specific property. Accordingly, many people merely overlook the small staked device. Further, such a device can be easily removed and therefore stolen or removed by vandals. Further, where two or more properties are closely located, someone searching for a particular home or business may become confused as to which property the small box is associated.

What is needed is a device which can overcome all of the deficiencies in the prior art. Such a device should be illuminated so that it can visually broadcast the property address indicia at night. Further, the device should be mounted to the mailbox so that people can easily find the location of the property they seek. Since the device does not need to illuminate the indicia during daylight hours, it should include a means for shutting off during daylight hours and thereafter illuminate during nighttime hours. The device would also excel over prior art devices if it is mounted directly to the mailbox to avoid be stolen. But at the same time, the device should be easy to install so that it can be retrofit to existing mailboxes already employed. Since batteries quickly discharge, it would also be advantageous to utilize rechargeable batteries. And, since daylight hours are present in most areas of the world at least some portion of the day, it would be advantageous to utilize a solar cell for recharging the batteries thereby eliminating the need for an external charging source. The device should also include a light means which is inexpensive and uses a minimal amount of power. Finally, the light means should be enclosed within a housing which permits light to diffuse outwardly from within while permitting indicia to be stenciled thereupon.

SUMMARY OF THE INVENTION

I have invented an improved property address indication device which overcomes all of the deficiencies seen in the prior art. My device mounts to the apex portion of a traditionally-shaped, generally rectangular mailbox. My device permits illumination of the address indicia at night through the use of a light means that is activated in the absence of ambient light.

In particular, my device includes a housing having a central channel formed under a pair of longitudinally disposed side walls, a top wall and a pair of opposed end walls. A bottom edge along each longitudinal side wall contains integrally formed ridges, extending inwardly towards one another for engaging a pair of longitudinally extending grooves formed in a bottom plate. The bottom plate mounts to the convexed-shaped top portion of the mailbox. A highly reflective film can be added to a top surface of the bottom plate to assist in dispersing the light given off by the light means.

Enclosed within the housing is at least one light source mounted underneath the housing top wall and which is powered by a battery. The batteries are energized by a solar cell mounted along an outer portion of the top wall of the housing. A small aperture formed in the top wall permits the solar cell to electrically couple to the battery via a wire. A photosensitive cell mounted proximal to the solar cell acts as a switch to turn the light means on and off based on the ambient light present therearound. Indicia mounted along each longitudinal side wall of the housing is thereby illuminated by the light means. The housing is slightly opaque allowing light to pass through but in a diffused state.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
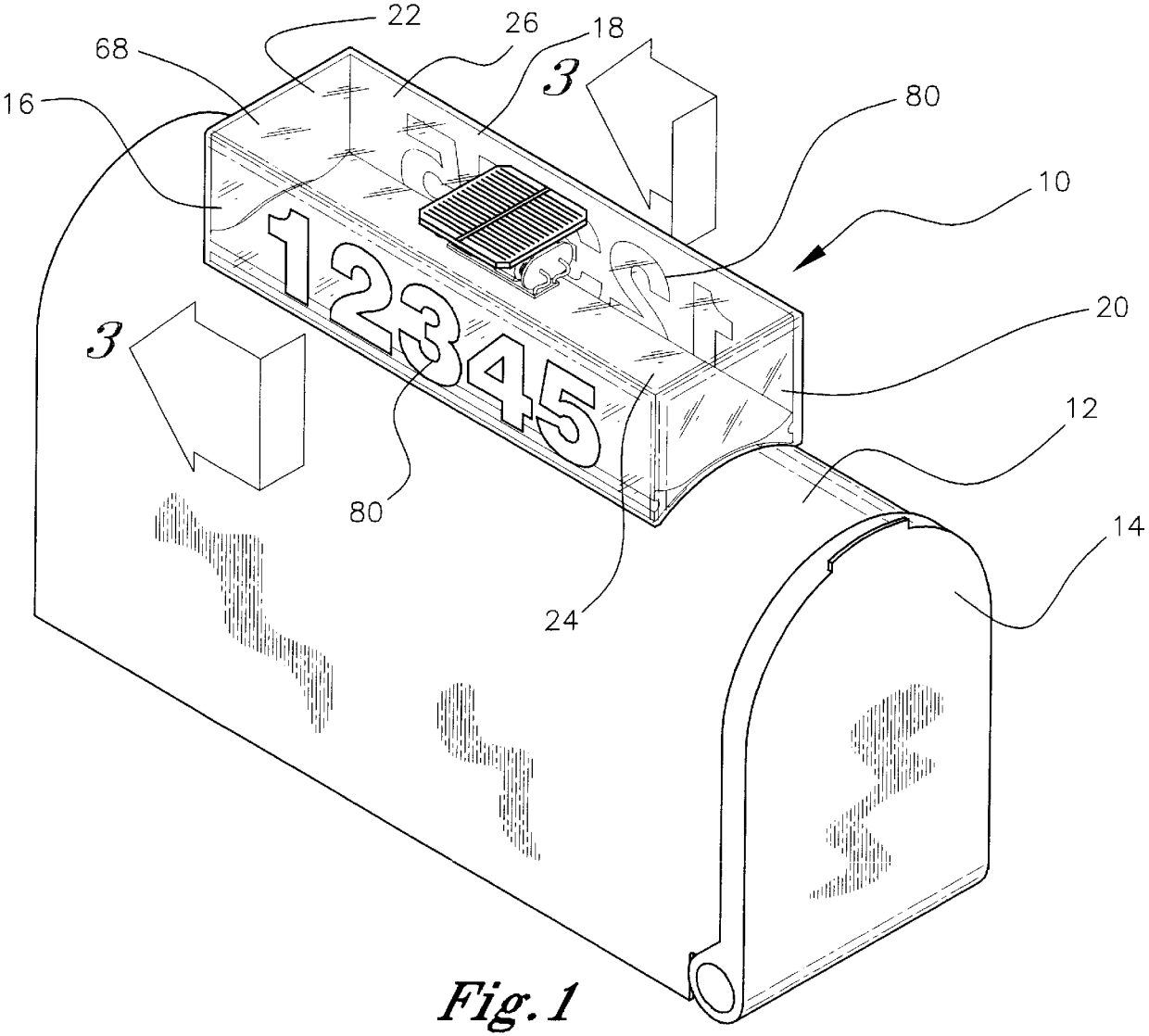
FIG. 1 is a perspective view of the illuminated mailbox address device of the present invention.

Throughout the following detailed description, the same reference numerals refer to the same elements in all figures.

Figure 3:
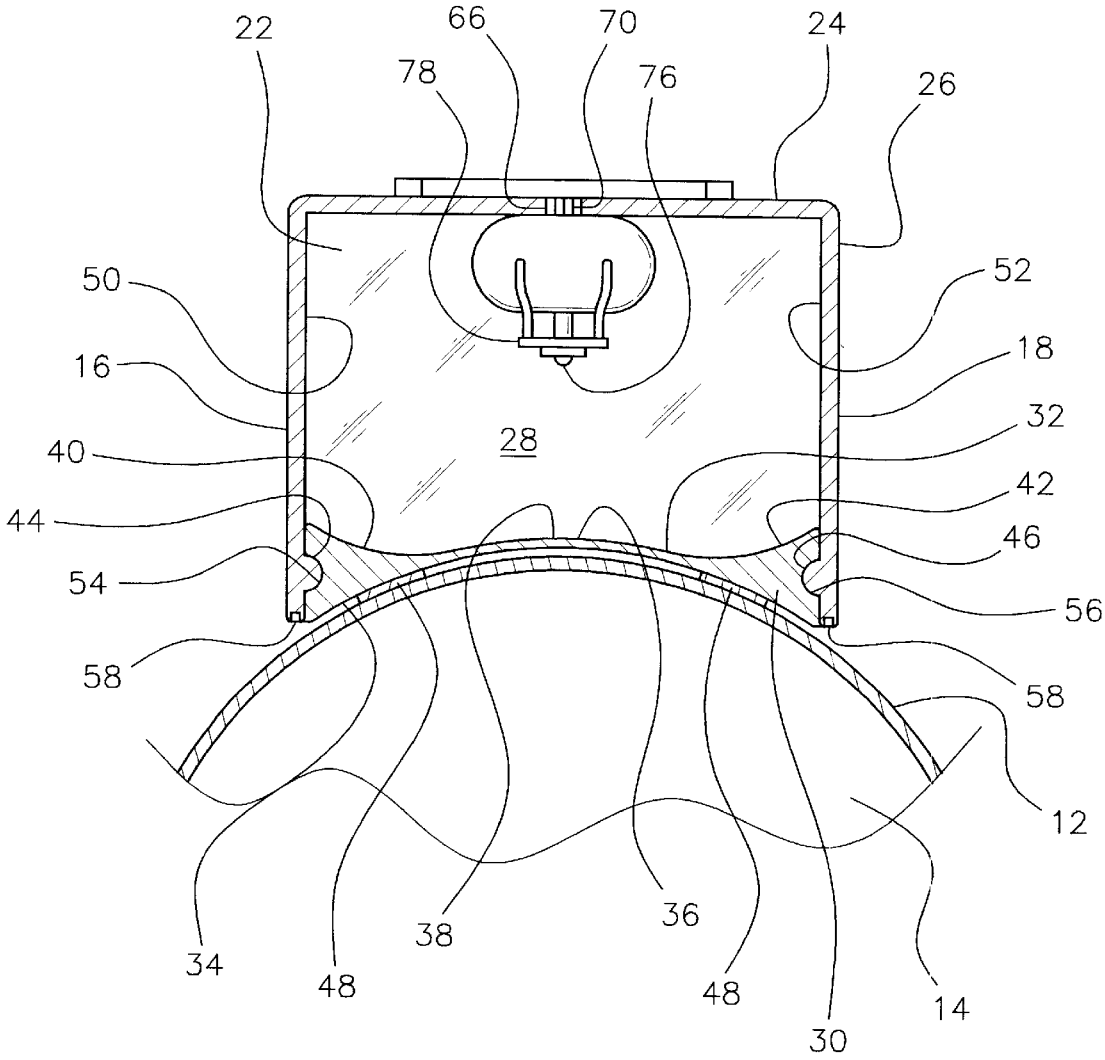
FIG. 3 is a front view, partially in section, of the present invention.

Referring to FIG. 1, an illuminated mailbox address device 10 is shown mounted on a top portion 12 of a traditionally-shaped, generally rectangular mailbox 14. Top portion 12 of mailbox 14 is convexed-shaped. Address device 10 includes a housing 26 having a pair of longitudinally disposed side walls 16 and 18, a front and back wall, 20 and 22, and a top wall 24. As shown in FIG. 3, housing 26 and its associated walls form a channel 28.

Figure 2:
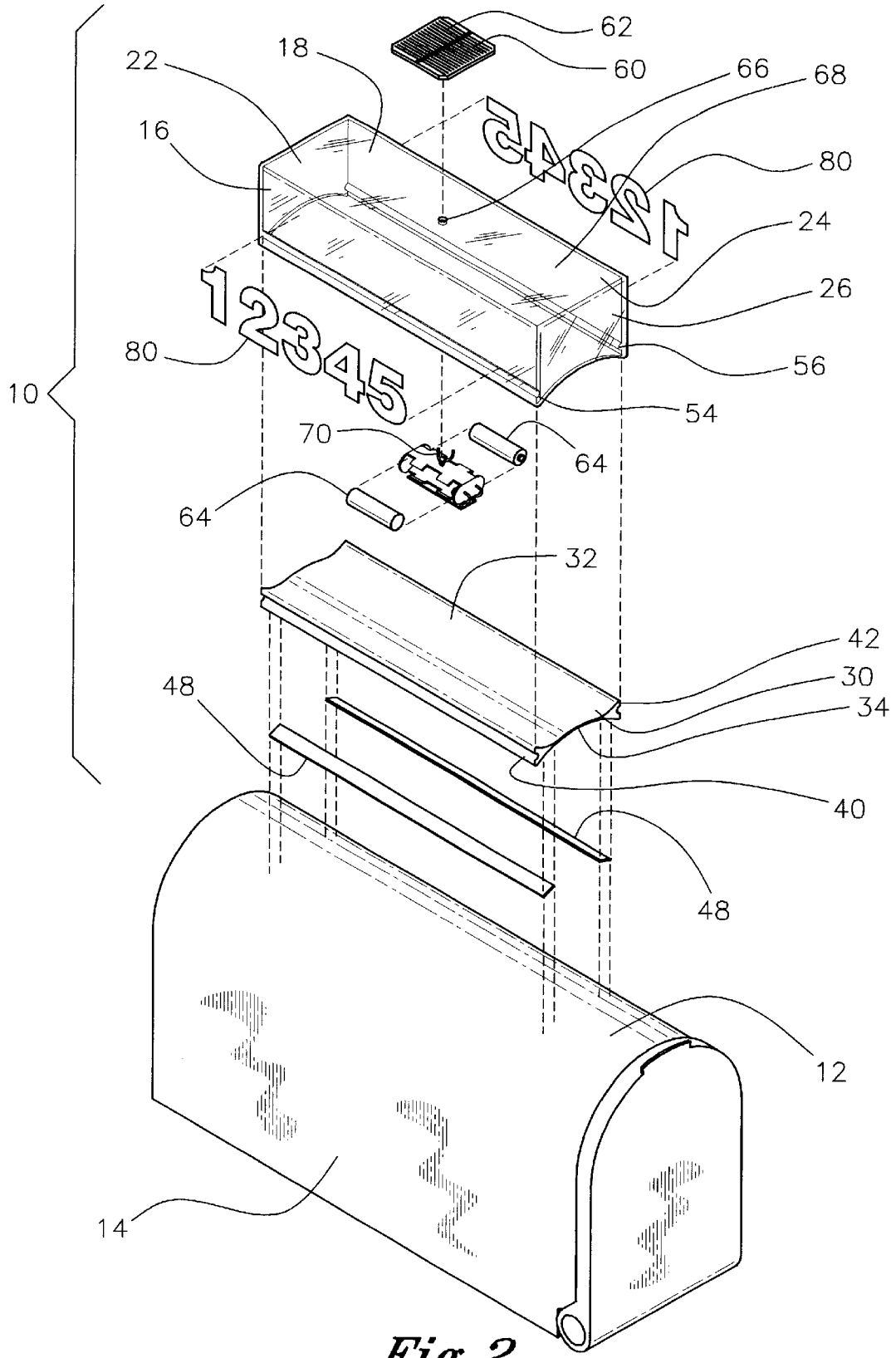
FIG. 2 is an exploded perspective view of the present invention.

Referring to FIG. 2, an exploded view of address device 10 is shown depicting the various elements of the invention. Besides those described hereinabove, address device 10 further includes a base member 30 which engages housing 26. Base member 30 ha s a top and bottom surface 32 and 34 respectively. Base member bottom surface 34 is convexed-shape and mates with mailbox top portion 12 (see also FIG. 3) which, as previously described, is concave-shaped. Base member top surface 32 is generally convexed-shaped, except that a slight wave portion 36 is formed at a middle section 38 there of. As shown in FIG. 3, base member 30 also includes opposed outwardly flanging side portions 40 and 42, each having a groove 44 and 46 formed along the longitudinal axis of each side portion 40 and 42. Along inner surfaces 50 and 52, respectively, of side walls 16 and 18 are a pair of ridges 54 and 56, respectively, longitudinally extending along the entire length of the each side wall 16 and 18. Ridges 54 and 56 mate with grooves 44 and 46 and ensure that housing 26 mates, by friction fit, to base member 30. As shown in FIG. 47 a small indention 58 is formed along a bottom edge 60 of at least one of the side walls, 16 or 18, permitting someone to insert a flat blade device (i.e., flat blade screw driver) and apply a small amount of pressure to "pop" housing 26 off from base member 30.

Referring once again to FIG. 2, it is shown that base member 30 attaches to mailbox top portion 12 by means of a pair of strips of double-sided tape 48. However, alternate means of attachment can be used, including, but not limited to, glue and screws. Address device 10 further includes a solar cell 60 (also known as a photovoltaic cell) and a photosensitive cell 62 mounted on a top surface 68 of housing top wall 24. Solar cell 60 collects energy from the sun during the daylight hours and energizes (recharges) a battery 64 mounted within housing 26. Photosensitive cell 62 acts as a switch to permit battery 64 to power a light means used with device 10. A small aperture 66 formed in housing top wall 24 permits a wire 70 to pass therethrough and electrically couple cells 60 and 62 to battery 64. In the preferred embodiment, a pair of rechargeable batteries 64 are used. Each battery is charged during the daylight hours by solar cell 60 collecting energy from the sun. As daylight diminishes, photosensitive cell 62, having a set threshold, reacts as a switch to permit energy to pass from batteries 64 to the light means thereby illuminating device 10.

Figure 4:
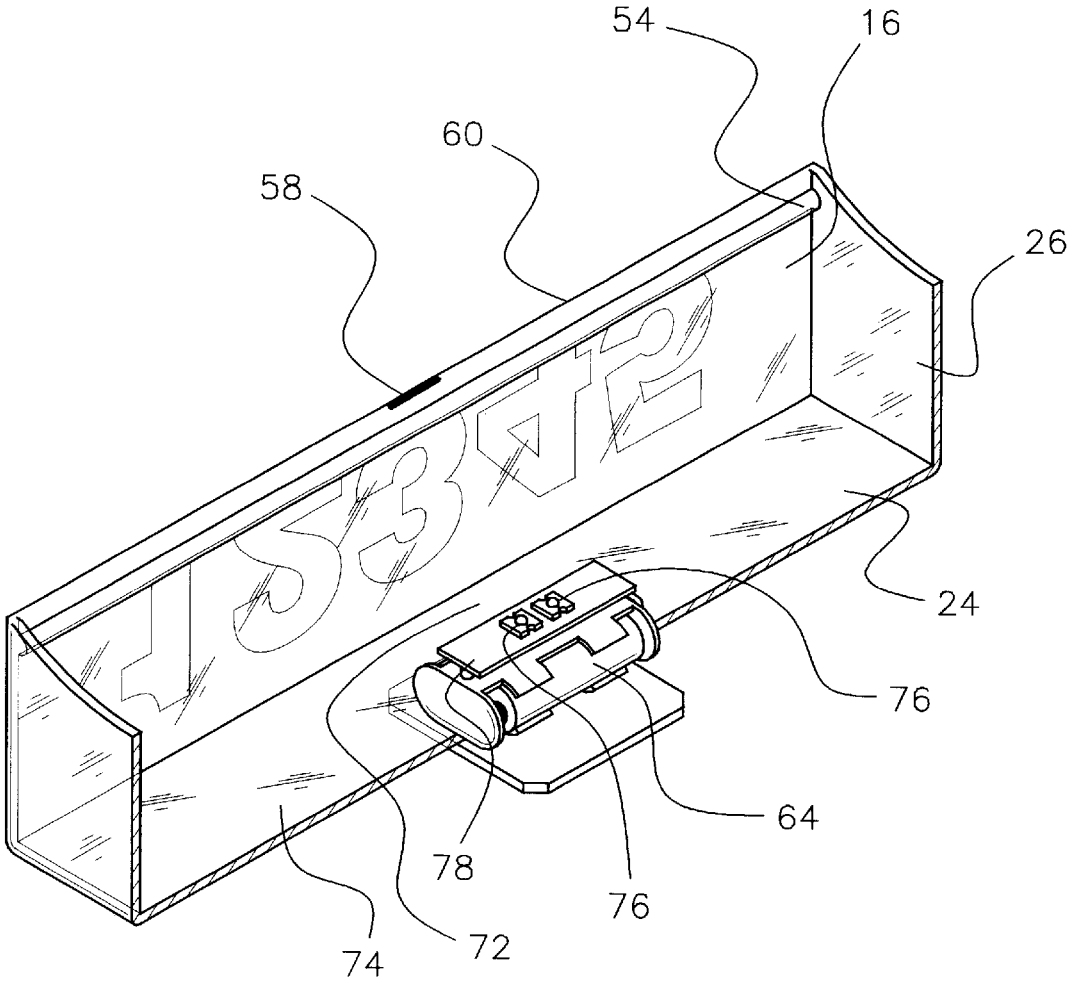
FIG. 4 is a bottom view, partially in section, of a housing used with the present invention depicting the use of a single light source.
Figure 5:
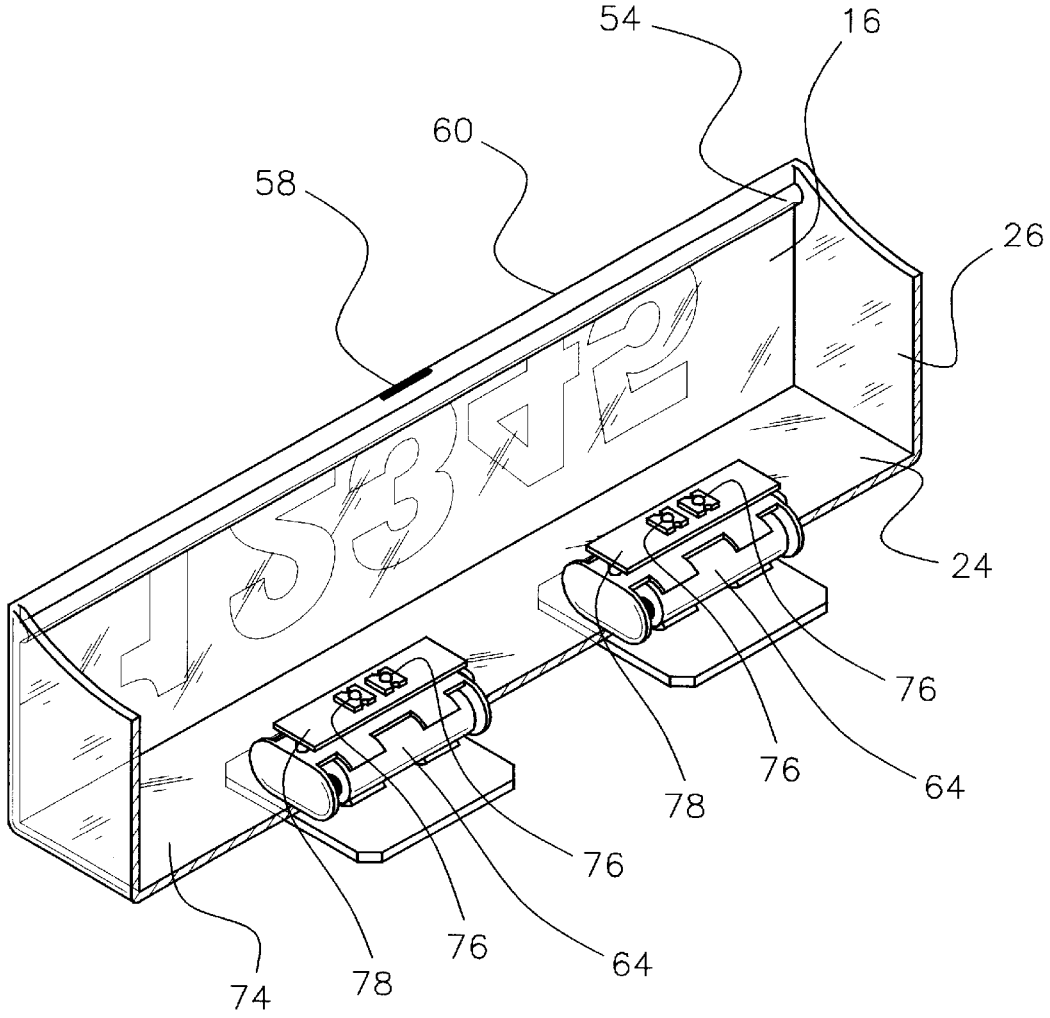
FIG. 5 is a bottom view, partially in section, of the housing used with the present invention depicting the use of a pair of light sources spaced from another.

As shown in FIG. 4, a single set of batteries 64 are used and are mounted along a central portion 72 of a bottom surface 74 of housing top wall 24. In the preferred embodiment, a pair of LEDs 76 are employed for the light means, although any sort of illuminating bulb could be used. LEDs 76 mount to a small circuit board 78 which is electrically coupled to batteries 64. Referring to FIG. 5, an alternate embodiment is shown wherein a pair of batteries 64 and a pair of LED pairs 76 are employed along bottom surface 74 of housing top wall 24. In such embodiment, batteries 64 and LEDs 76 are evenly spaced form one another to enhance the dispersion of light. Still further alternate embodiments, although not shown, utilize dispersion brackets mounted around the light means to enhance the light dispersion.

As shown in FIGS. 1 and 2, indicia 80 are mounted on device 10. In the preferred embodiment, indica 80 are mounted along side walls 16 and 18. Housing 26 is slightly opaque and permits light to illuminate therefrom out. In the preferred embodiment, back letter indicia are employed.

In the preferred embodiment, housing 26 and base member 30 are made from a polymer, including but not limited to, polyethylene, polypropylene, polyurethane and polyvinyl chloride. Base member top surface 32 can further include a highly reflective material to assist in dispersing the light generated by the light means. Such material could include a reflective sheet of material glued to base member top surface 32.

Equivalent elements can be substituted for the ones set forth above such that they perform the same function in the same way for achieving the same result.

Having thus described the invention what is claimed and desired to be secured by Letters Patent is:

1. An illuminating address indication device comprising:

a) a one piece housing having a pair of longitudinal side walls, a pair of opposed end walls and a top wall, the longitudinal side walls, opposed end walls and top wall forming an inner channel, each longitudinal side wall having a bottom edge, an inner surface and a ridge protruding from the inner surface proximal to the longitudinal side wall bottom edge, the housing permitting light to shine through each wall, b) a base member having a pair of opposed outwardly flanging side portions, each side portion having a groove formed along an outer edge, the base member mounted to a top portion of a mailbox, one ridge of each housing longitudinal side wall mating with one groove of each base member side portion, c) light means mounted within the housing inner channel for illuminating the address indication device, d) at least one battery electrically coupled to the light means for supplying power thereto, e) a photosensitive cell mounted on the housing for operating a switch in response to a pre-determined threshold of ambient light being exceeded, the switch electrically coupled between the battery and the light means; and f) indicia mounted on at least one housing longitudinal side wall.

2. The illuminating address indication device of claim 1 wherein the at least one battery comprises a pair of rechargeable batteries.

3. The illuminating address indication device of claim 1 wherein the light means is pair of LED lights mounted on a circuit board, the circuit board proximally mounted to the at least one battery.

4. The illuminating address indication device of claim 1, further comprising a solar cell mounted on the housing for collecting sunlight radiation and energizing the at least one battery.

5. The illuminating address indication device of claim 4 wherein the solar cell and photosensitive cell are integrally attached and mounted upon the housing top wall.

6. The illuminating address indication device of claim 1 further comprising the base member having top and bottom surfaces, the top surface having a sheet of highly reflective material mounted thereupon.

7. The illuminating address indication device of claim 1 wherein the at least one battery is two rechargeable battery pairs.

8. The illuminating address indication device of claim 7 wherein the light means is a pair of LED light pairs, each pair of LED lights mounted on a separate circuit board, each circuit board mounted to one of the two battery pairs, each battery pair supplying power to its associated LED light pair in response to the pre-determined threshold of the photosensitive cell being exceeded thereby causing the switch to close.

9. An illuminating address indication device comprising:

a) a one piece housing having a pair of longitudinal side walls, a pair of opposed end walls and a top wall, the longitudinal side walls, opposed end walls and top wall forming an inner channel, each longitudinal side wall having a bottom edge, an inner surface and a ridge protruding from the inner surface proximal to the longitudinal side wall bottom edge, the housing permitting light to shine through each wall, b) a base member attaching to the housing and having a pair of opposed outwardly flanging side portions and a top and bottom surface, the bottom surface having a concave-shape, each side portion having a groove formed along an outer edge, the base member concave-shaped bottom surface mounted to a convexed-shaped top portion of a mailbox, one ridge of each housing longitudinal side wall mating with one groove of each base member side portion, the mailbox having a generally rectangular shape, a flat bottom portion, a pair of upwardly extending side walls, a closed back portion, a front door, and the convexed-shaped top portion, c) light means mounted within the housing inner channel for illuminating the address indication device, d) at least one battery electrically coupled to the light means for supplying power thereto, e) a photosensitive cell mounted on the housing for operating a switch in response to a pre-determined threshold of ambient light being exceeded, the switch electrically coupled between the battery and the light means, f) a solar cell mounted on the housing for collecting sunlight radiation and energizing the at least one battery, and g) indicia mounted on at least one housing longitudinal side wall.

10. The illuminating address indication device of claim 9 further comprising each housing longitudinal side wall bottom edge having a bottom surface and a notch formed in at least one housing longitudinal side wall bottom edge bottom surface.

11. The illuminating address indication device of claim 9 wherein the solar cell and photosensitive cell are integrally attached and mounted upon the housing top wall.

12. The illuminating address indication device of claim 9 wherein the at least one battery comprises a pair of rechargeable batteries.

13. The illuminating address indication device of claim 9 further comprising a sheet of highly reflective material mounted upon the base member top surface.

14. The illuminating address indication device of claim 9 wherein the light means is at least one pair of LED lights mounted on a circuit board, the circuit board proximally mounted to the at least one battery.

15. An illuminating address indication mailbox comprising:

a) a container having a flat bottom portion, a pair of upwardly extending side walls, a back wall, a front door, and a top wall, the container forming an inner compartment for receiving mail, the container supported by a vertical post mounted to a ground surface, b) a one-piece housing having a pair of longitudinal side walls, a pair of opposed end walls and a top wall, the longitudinal side walls, opposed end walls and top wall forming an inner channel, each wall being translucent, the housing mounted upon the container top wall, c) light means mounted within the housing inner channel for illuminating the address indication mailbox, d) at least one battery electrically coupled to the light means for supplying power thereto, e) a photosensitive cell mounted on the housing for operating a switch in response to a pre-determined threshold of ambient light being exceeded, the switch electrically coupled between the battery and the light means, and f) indicia mounted on at least one longitudinal side wall of the housing.

16. The illuminating address indication mailbox of claim 15 further comprising a solar cell mounted on the housing for collecting sunlight radiation and energizing the at least one battery.

17. The illuminating address indication mailbox of claim 15 wherein the container top wall is convexed-shaped and the housing includes a removable base member, the removable base member having a concave-shaped bottom surface for mounting to the container top wall.

18. The illuminating address indication mailbox of claim 15 wherein the light means is at least one pair of LEDs mounted to a circuit board, the circuit board electrically coupled to the at least one battery, the battery coupled to the photosensitive cell by a wire passing through an aperture formed in the housing top wall.

* * * * *